US005571008A

United States Patent [19]

Richardson et al.

[11] Patent Number: 5,571,008

[45] Date of Patent: Nov. 5, 1996

[54] GAS BURNER FOR USE WITH ARTIFICIAL LOGS

[75] Inventors: Stephen F. Richardson, Randolph Center; Shawn T. Malloy, Bethel; Jay F. Kempf, Colchester; Frank G. Medros, Bethel, all of Vt.; Steven M. Ballou, Hanover, N.H.

[73] Assignee: Vermont Castings, Inc., Bethel, Vt.

[21] Appl. No.: 270,163

[22] Filed: Jul. 1, 1994

[51] Int. Cl.[6] ..... F23C 3/00

[52] U.S. Cl. ..... 431/125; 126/92 R; 126/92 AC; 126/512

[58] Field of Search ..... 431/125; 126/4, 126/92 R, 92 AC, 500, 512, 350 R

[56] References Cited

U.S. PATENT DOCUMENTS

| | | | |
|---|---|---|---|
| D. 245,993 | 10/1977 | Anderson et al. | D23/93 |
| D. 273,321 | 4/1984 | Cosper | D23/90.1 |
| 3,042,109 | 7/1962 | Peterson | 158/113 |
| 3,291,116 | 12/1966 | Brooks | 126/92 |
| 3,362,395 | 1/1968 | Peterson | 126/92 |
| 3,382,861 | 5/1968 | Peterson | 126/92 |
| 3,543,741 | 12/1970 | Whitehead | 126/92 |
| 3,696,801 | 10/1972 | Whitehead | 126/92 R |
| 3,723,046 | 3/1973 | Poling et al. | 431/18 |
| 3,747,585 | 7/1973 | Coats | 126/92 R |
| 3,760,790 | 9/1973 | Voges et al. | 126/92 R |
| 3,805,762 | 4/1974 | Nelson | 126/4 |
| 3,817,686 | 6/1974 | Quittner | 431/125 |
| 3,842,821 | 10/1974 | Juris | 126/125 |
| 3,871,355 | 3/1975 | Henry | 126/127 |
| 4,000,732 | 1/1977 | White | 126/92 F |
| 4,061,133 | 12/1977 | Swain | 126/350 R |
| 4,306,537 | 12/1981 | Mitchell | 126/92 AC |
| 4,502,463 | 3/1985 | Gregory | 126/121 |
| 4,573,446 | 3/1986 | Rosiek et al. | 126/92 R |
| 4,573,905 | 3/1986 | Meyers | 431/125 |
| 4,582,478 | 4/1986 | Hilker | 431/125 |
| 4,602,609 | 7/1986 | Wright | 126/92 AC |
| 4,637,372 | 1/1987 | Mogol et al. | 126/127 |
| 4,793,322 | 12/1988 | Shimek et al. | 126/80 |
| 4,886,445 | 12/1989 | Richardson | 431/125 |
| 4,971,030 | 11/1990 | Thow et al. | 126/512 |
| 4,976,253 | 12/1990 | Beal et al. | 126/512 |
| 5,092,313 | 3/1992 | Blackburn et al. | 126/512 |

FOREIGN PATENT DOCUMENTS

| | | |
|---|---|---|
| 1561099 | 2/1980 | United Kingdom . |
| 2179438 | 3/1987 | United Kingdom . |
| 2185100 | 7/1987 | United Kingdom . |
| 2156507 | 1/1988 | United Kingdom . |
| 2208703 | 4/1989 | United Kingdom . |

*Primary Examiner*—Larry Jones
*Attorney, Agent, or Firm*—Wolf, Greenfield & Sacks, P.C.

[57] ABSTRACT

A gas burner for use with artificial logs in a gas log heater includes a thin metal top member having substantially flat upper and front burner surfaces, and a metal base member affixed to the top member. The top member and the base member define a burner cavity which may have a generally L-shaped cross section. The upper burner surface has top gas ports, and the front burner surface has front gas ports in gas communication with the burner cavity. The base member has an inlet port that is located with respect the gas ports so as to limit pressure differentials between the gas ports. A mixing tube supplies a mixture of air and gas from a gas source to the inlet port of the burner cavity.

10 Claims, 4 Drawing Sheets

GAS BURNER FOR USE WITH ARTIFICIAL LOGS

FIELD OF THE INVENTION

This invention relates to gas burning heaters which utilize artificial logs to provide a decorative and realistic appearance and, more particularly, to gas burners for use in such heaters.

BACKGROUND OF THE INVENTION

Gas log heaters which burn gas and which utilize artificial logs to simulate the appearance of burning wood logs are known in the art. Such heaters may be in form of a fireplace insert or a free-standing heater having a window for viewing the artificial logs. The heaters typically include several artificial logs of a ceramic or other refractory material designed to simulate the appearance of wood logs. A gas burner supplies a mixture of a flammable gas and air underneath the artificial logs. The gas is burned to produce a flame in the vicinity of the logs. The heater can include a tank or reservoir for holding the flammable gas, or can be connected to a remote gas source. Heaters utilizing artificial log assemblies provide heat and the pleasing appearance of a wood fire, while avoiding the inconvenience and lack of cleanliness associated with the loading of wood into and removal of ashes from conventional wood burning stoves and fireplaces.

One objective in the design and construction of gas log heaters is to provide artificial logs that look like real logs and to provide gas flames which closely simulate the flames produced by burning wood, so that an overall effect of burning wood is produced. The size and color of the flames and their positions relative to the artificial logs are important in producing a realistic effect. Other important objectives in the design and construction of gas log heaters include providing high heat output, providing high combustion efficiency, minimizing the soot and noxious gases produced by combustion and minimizing the cost of the heater.

The design of the gas burner is important in producing flames which simulate those of burning wood logs and in controlling emissions of noxious gases, such as carbon monoxide. One type of prior art gas burner, known as a tube burner, employs a pipe that is closed at one end and is connected to a gas source at the other end. The pipe includes a series of spaced holes which supply gas in the region of the artificial logs. Examples of tube type gas burners are disclosed in U.S. Pat. Nos. 3,362,395 issued Jan. 9, 1968 to Peterson; 3,042,109 issued Jul. 3, 1962 to Peterson; 3,871,355 issued Mar. 18, 1975 to Henry; 3,543,741 issued Dec. 1, 1970 to Whitehead; and 3,760,790 issued Sep. 25, 1973 to Voges et al. The disclosed gas burners are relatively low in cost and can be operated with high efficiency. However, these burners typically produce a row of steady blue flames which are not effective in simulating burning wood logs.

A gas burner fabricated of a refractory fiber material is disclosed in U.K. Patent No. 2,156,507, published Oct. 9, 1985. A gas log fireplace utilizing a ceramic gas burner fabricated of a refractory fiber material is disclosed in U.S. Pat. No. 5,092,313 issued Mar. 3, 1992 to Blackburn et al. The ceramic gas burner includes a refractory fiber insulating body having a plurality of front and top ports, a Venturi tube inlet for receiving a combustible gas and primary air, and an interior chamber connecting the inlet to the front ports and to the top ports. The ceramic gas burner is effective, in combination with artificial logs, in simulating a wood fire.

However, the ceramic gas burner is difficult to manufacture and may be subject to damage during use. Furthermore, the ceramic gas burner does not meet recently-imposed standards for carbon monoxide emissions, requires on the order of 15–20 minutes to reach steady state combustion, and is occasionally subject to flashback into the burner cavity when the gas is turned off.

Additional gas burner and artificial log assemblies are disclosed in U.S. Pat. No. 4,306,537 issued Dec. 22, 1981 to Mitchell, U.S. Pat. No. 4,886,445 issued Dec. 12, 1989 to Richardson and U.K. Patent Application Nos. 2,208,703 (Izzard); 2,185,100 (Wright); and 2,179,438 (Bleach). All known prior art gas log heaters have had one or more disadvantages, including an unrealistic appearance, low combustion efficiency, lack of reliability and durability, unacceptable emissions of noxious gases and difficulties in manufacturing.

SUMMARY OF THE INVENTION

A gas burner in accordance with the present invention comprises a thin metal top member having substantially flat, intersecting upper and front burner surfaces, and a metal base member affixed to the top member. The top member and the base member define a burner cavity. The upper burner surface has top gas ports in gas communication with the burner cavity, and the front burner surface has front gas ports in gas communication with the burner cavity. The base member has an inlet port that is located with respect to the top and front gas ports so as to limit pressure differentials between the gas ports. The gas burner further includes a mixing tube for supplying a mixture of air and gas from a gas source to the inlet port.

Preferably, the inlet port is located so as to supply the mixture of air and gas to the burner cavity from below. In a preferred embodiment, the upper portion of the burner cavity has a substantially constant thickness perpendicular to the upper surface, except in the region of the inlet port, and the front portion of the burner cavity has a substantially constant thickness perpendicular to the front surface. The front gas ports preferably comprise a plurality of elongated horizontal slits in a linear arrangement. The horizontal slits produce a sheet of flame from front portion of the gas burner. In a preferred embodiment, the top member comprises a single sheet of stainless steel having substantially constant thickness, and the base member comprises cast iron.

According to another aspect of the invention, a gas log heater comprises a firebox defining a combustion chamber and including an air inlet and an exhaust gas outlet, a gas burner located within the firebox, and artificial logs located within the firebox and positioned relative to the gas burner such that the gas burner produces flames around the artificial logs. The gas burner has the structure described above. The flames and the artificial logs simulate the appearance of a wood fire.

BRIEF DESCRIPTION OF THE DRAWINGS

For a better understanding of the present invention, reference is made to the accompanying drawings, which are incorporated herein by reference and in which.

DETAILED DESCRIPTION

Figure 1A:
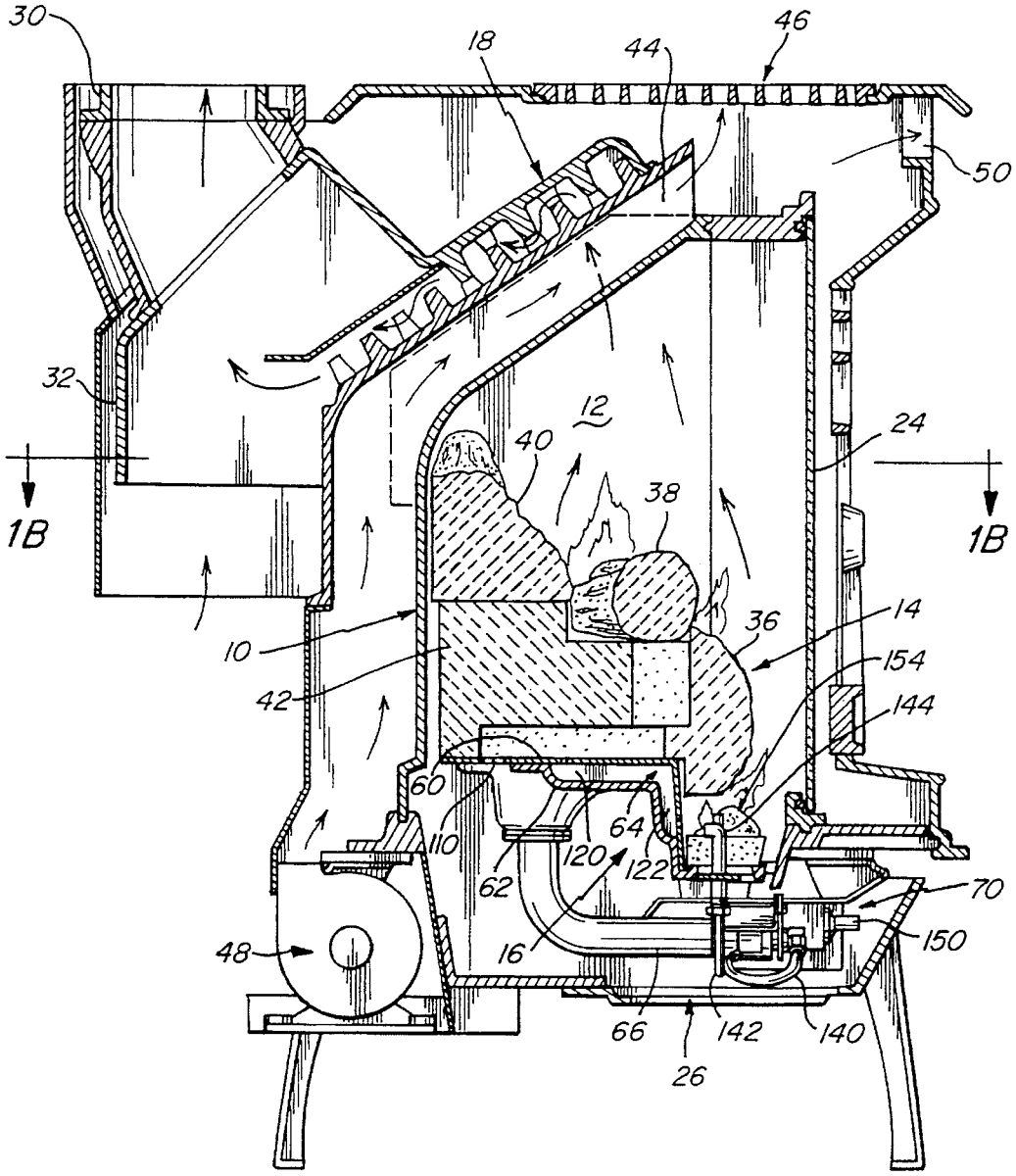
FIG. 1A is a cross-sectional, elevation view of a free-standing gas log heater incorporating a gas burner in accordance with the present invention.
Figure 1B:
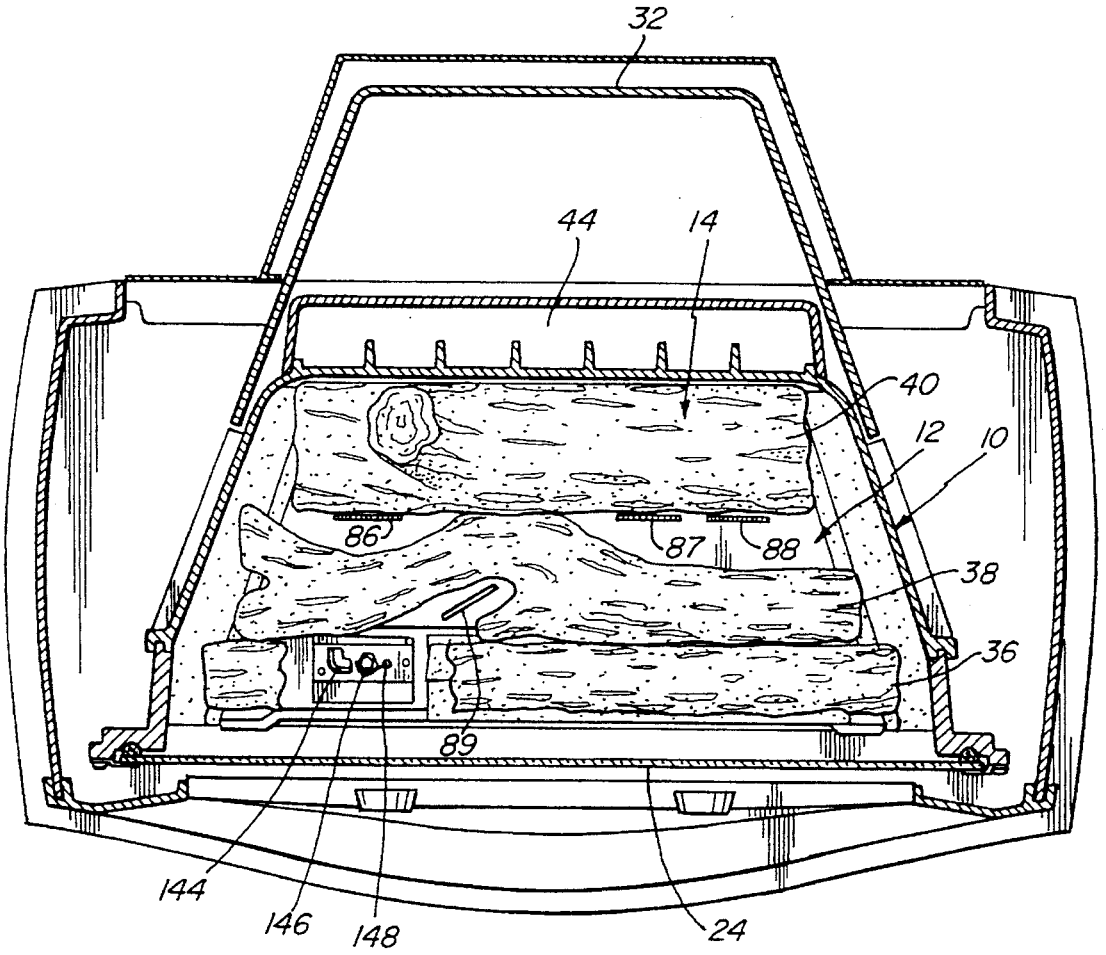
FIG. 1B is a cross-sectional top view of the gas log heater, taken along the line 1B—1B of FIG. 1A.
Figure 2:
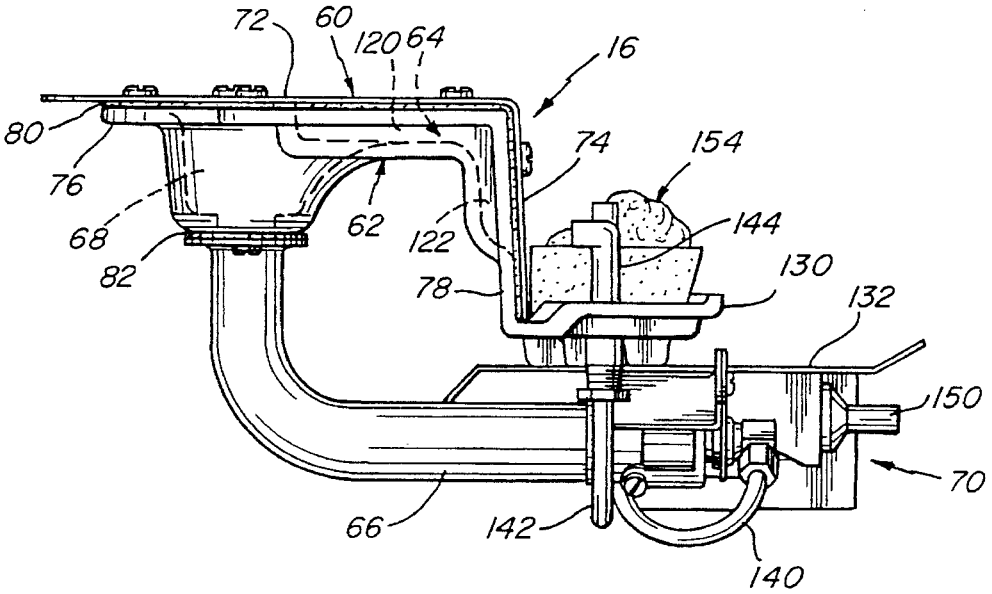
FIG. 2 is a side elevation view of the gas burner of the present invention.

A gas log heater incorporating a gas burner in accordance with the present invention is shown in FIGS. 1A and 1B. The principal components of the gas log heater are a firebox 10 which encloses a combustion chamber 12, an artificial log set 14, a gas burner assembly 16, a heat exchanger 18, and means for producing a convection flow of room air over the firebox 10 and the heat exchanger 18.

The firebox 10 includes top, side and rear walls, which may be fabricated of cast iron. The front of the firebox 10 is closed by a transparent window 24 to permit viewing of the artificial log set 14 and the flames within the firebox. The gas burner assembly 16 is supported by a ledge (not shown) within the firebox. The firebox 10 further includes an air inlet 26 at its bottom for receiving combustion air and exhaust conduits (not shown) for carrying exhaust gas from combustion chamber 12 to heat exchanger 18. The exhaust gas then passes from the heat exchanger 18 to a flue collar 30, which connects to a stovepipe (not shown) that extends to the exterior of the home. A draft hood 32 permits make-up air to flow from the room into the stovepipe so as to control the draft in the combustion chamber 12.

The artificial log set 14 preferably includes a front log 36, a top log 38 and a back log 40 fabricated of a ceramic or other refractory material. The artificial logs 36, 38 and 40 are supported above the gas burner assembly 16 by a support member 42, which is preferably fabricated of a refractory fiber material. The structure of the artificial log set 14 and the support member 42 is shown and described in detail in the aforementioned U.S. Pat. No. 5,092,313, which is hereby incorporated by reference.

A passage 44 extends over the rear and the top of firebox 10 to a grill 46 at the top of the heater and an opening 50 at the front of the heater. The heat exchanger 18 is in thermal contact with the passage 44. The air in passage 44 is heated by the firebox 10 and by the heat exchanger 18 so that heated air flows by convection through grill 46 and opening 50 into the home. An optional blower assembly 48 can be used to provide forced convection through passage 44.

The gas burner assembly 16, shown in detail in FIGS. 2–5, includes a top member 60 and a base member 62 which define a burner cavity 64. The gas burner assembly 16 also includes a mixing tube 66 for supplying a mixture of air and gas to the burner cavity 64 through an inlet port 68, and gas controls 70 for controlling the supply of gas to the burner cavity 64 and for ignition of the gas after it emerges from the burner cavity.

In a preferred embodiment, the top member 60 is fabricated from a thin metal sheet formed into a right angle configuration, and the base member 62 is fabricated of cast iron. The right angle configuration of top member 60 defines a flat upper burner surface 72 and a flat front burner surface 74. The base member 62 includes a flange 76 for attachment to the upper portion of top member 60 and a flange 78 for attachment to the front portion of top member 60. A gasket 80 is located between top member 60 and base member 62 to prevent gas leaks. In addition, a gasket 82 seals the mixing tube 66 to inlet port 68. Thus, the burner cavity 64 is sealed, except at the inlet port 68 and at the gas ports which supply gas to the combustion chamber 12 as described below.

The upper surface 72 of top member 60 includes top gas ports 86, 87, 88, 89 and 90. The front surface 74 of top member 60 is provided with front gas ports 92–100. Each of the top gas ports and the front gas ports is formed as an elongated slit that extends from the top or front surface through the top member 60 to the burner cavity 64. In a preferred embodiment, the top gas ports 86–90 have widths of 0.093 inch. The front gas ports 92–99 are preferably formed as a linear arrangement of horizontal slits and produce a sheet of flame at the front of the burner. The front gas port 100 has a vertical orientation and is used to conduct flame from the pilot to the top gas ports 86–90 for ignition. The horizontal gas ports 92–99 are important in achieving efficient mixing of gas with secondary air and in providing superior flame appearance. In addition, the vertical gas port 100 and the adjacent horizontal gas ports 94 and 95 are important in achieving reliable flame carry over from the pilot 144 to the top gas ports. In a preferred embodiment, the front gas ports 93, 96, 97, 98 and 99 have widths of 0.073 inch and front gas ports 92, 94, 95 and 100 have widths of 0.062 inch. The top member 60 of the gas burner further includes openings 110, 112 and 114 located external to burner cavity 64 for supplying secondary air to the upper burner surface 72 in the region of top gas ports 86, 87 and 88. In general, the top member of the gas burner may include two or more intersecting surfaces, each having gas ports.

The burner cavity 64 has a size and shape that provides relatively uniform gas pressure at the top and front gas ports so that the flame pattern is relatively uniform. In addition, the volume of the burner cavity 64 is relatively small, and pressure differentials between gas ports are limited, thereby reducing the possibility of flashback into the burner cavity when the gas is turned off.

Figure 3:
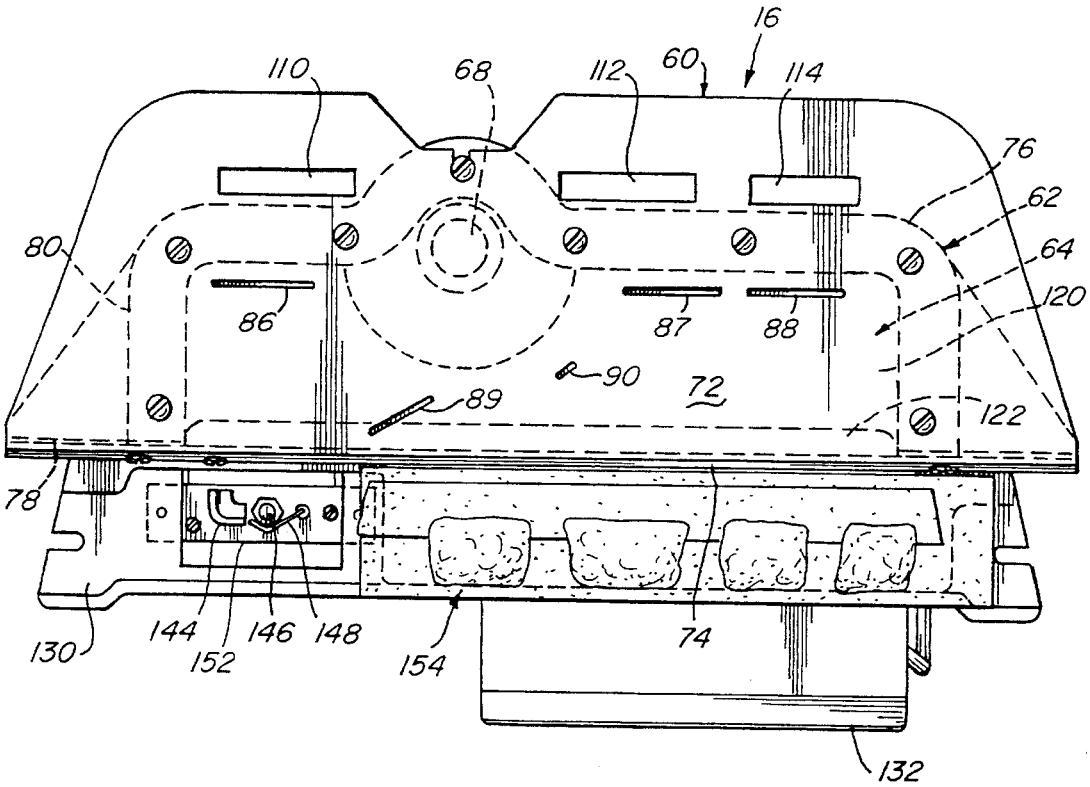
FIG. 3 is a top view of the gas burner of the present invention.
Figure 4:
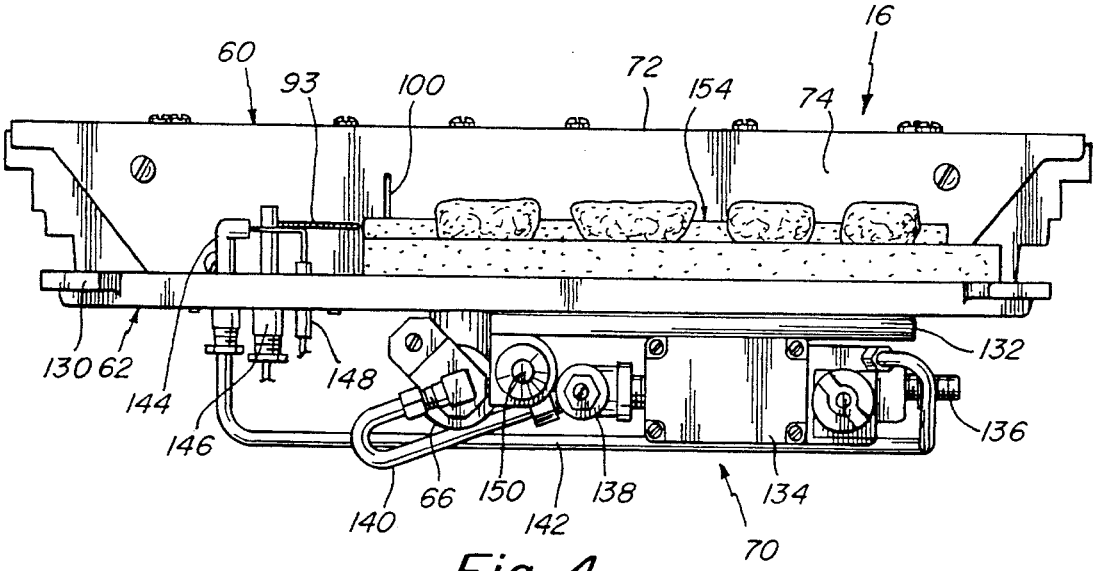
FIG. 4 is a front view of the gas burner of the present invention.
Figure 5:
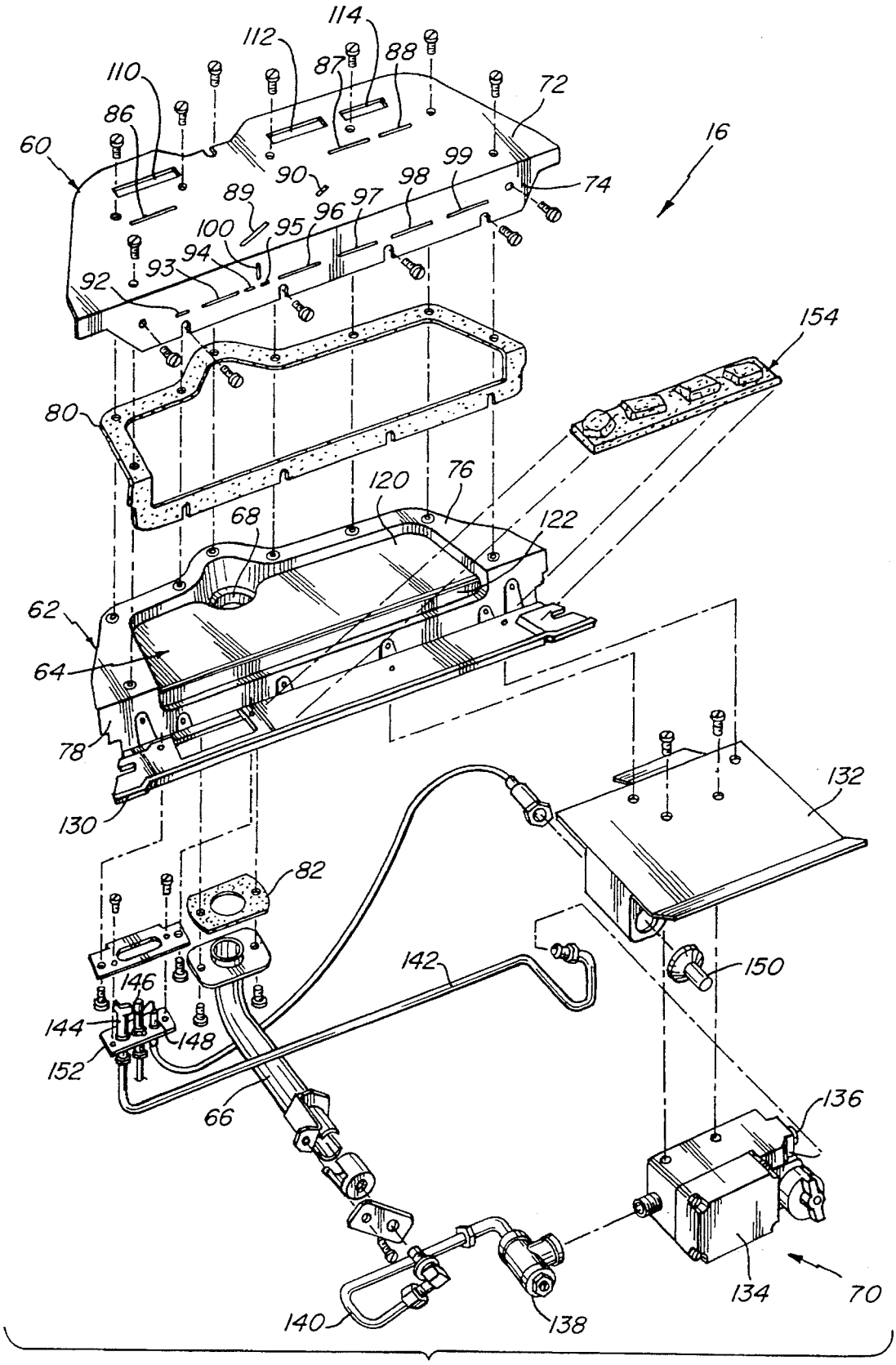
FIG. 5 is an exploded view of the gas burner of the present invention.

A preferred shape of burner cavity 64 is illustrated in FIGS. 1A, 2, 3 and 5. Burner cavity 64 preferably has a generally L-shaped cross section in a plane perpendicular to the front of the heater (FIG. 1A), including a flat upper portion 120 below upper burner surface 72 and a flat front portion 122 behind front burner surface 74. Burner cavity 64 is elongated in a direction parallel to the front of the heater (FIG. 3). The front portion 122 of the burner cavity 64 preferably has a generally uniform thickness perpendicular to front surface 74, and upper portion 120 preferably has a generally uniform thickness perpendicular to top surface 72, except in the region of inlet port 68. The inlet port 68 is preferably located so as to supply a mixture of air and gas to the upper portion 120 of gas burner 64 from below. The base member 62 has a downward bulge in the region of inlet port 68 so that the incoming mixture of gas and air expands and reduces in velocity as it enters the burner cavity 64. This reduces the tendency for pressure differentials within the burner cavity and tends to equalize the flow of gas through the top and front gas ports.

Preferably, the burner cavity 64 has a volume in the range of about 30 to 32 cubic inches and a thickness perpendicular to the top member 60 of about ½ inch. It will be understood that the dimensions and volume of the burner cavity can be scaled for different applications. However, the volume of the burner cavity should be relatively small. This allows for more direct transmission of the air/gas mixture from the mixing tube 66 to the gas ports and thereby reduces the incidence and severity of flashback when the gas is turned off. Furthermore, the gas ports should not be located in the immediate vicinity of the inlet port to allow more even distribution of gas to all gas ports. This prevents overfeeding gas ports closest to the inlet port and starving those farthest away. The result is a more uniform and repeatable flame pattern.

The metal structure of gas burner assembly 16 heats up quickly and reaches a steady state operating temperature in a relatively short time. The gas burner assembly of the present invention typically reaches steady state combustion in about 10 minutes. This is important in reducing emissions of noxious gases during the warmup period.

It has been found that the thickness of the material used to fabricate the top member 60 is important in achieving low emissions of carbon monoxide. Best results have been obtained when the thickness of the top member 60, at least in the regions around the top gas ports and the front gas ports, has a thickness of about 1/16 inch. In the preferred embodiment, the top member 60 of the gas burner is fabricated of 16 gauge, type 430 stainless steel.

The base member 62 of the gas burner assembly 16 includes a generally horizontal shelf 130 that extends forwardly of the front burner surface 74 for mounting of the gas controls 70. A valve bracket 132 is affixed to the bottom of shelf 130, and a gas control valve 134 is mounted to bracket 132. The gas control valve 134 can be a conventional gas valve, such as a type 7000 Robertshaw. The gas control valve 134 receives gas from a source through an inlet 136 and supplies gas through a tee fitting 138 and a tube 140 to the mixing tube 66. The mixing tube 66 includes a shutter for controlling the quantity of air that is mixed with the gas before it enters the burner cavity 64. The gas control valve 134 also supplies gas through a tube 142 to a pilot 144. A thermopile 146 mounted adjacent to pilot 144 is electrically connected to gas control valve 134. Thermopile 146 is heated by the flame and keeps the gas control valve 134 open as long as the pilot flame is present. An ignition wire 148 is electrically connected to an igniter 150. When the igniter 150 is pushed, ignition wire 148 generates a spark for ignition of the pilot flame. The pilot 144, the thermopile 146 and the ignition wire 148 are mounted to the shelf 130 via a pilot bracket 152. An ember strip 154 is positioned on the shelf 130 adjacent to the pilot 144, the thermopile 146 and the ignition wire 148. The ember strip 154 partially covers the front burner surface 74, as viewed through window 24, and supplements the artificial log set 14 in simulating the appearance of a wood fire.

The performance of a gas log heater constructed as shown and described above was evaluated. The carbon monoxide emissions of the gas burner assembly 14 were in the range of 140 parts per million ±25 parts per million. By contrast, the carbon monoxide emissions for the prior art ceramic burner were 375 parts per million ±75 parts per million for LP gas and over 400 parts per million for natural gas. The flame appearance for the gas burner assembly 16 was nearly identical from burner to burner and produced well balanced flames. The air shutter in the mixing tube 66 permits the flame color to be adjusted. By contrast, the prior art ceramic burner produced flames which were variable from burner to burner, produced small rear flames and generally long and sooty middle and front flames. No sooting of any type was observed in a long term test (1700 hours) of the gas burner assembly 16. By contrast, many of the prior art ceramic burners produce unacceptable sooting.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A gas burner comprising:

a thin metal top member having substantially flat, intersecting upper and front burner surfaces;

a metal base member affixed to said top member and, together with said top member, defining a burner cavity, said burner cavity including an upper portion below said upper burner surface and a front portion behind said front burner surface, the upper portion of said burner cavity having a substantially constant thickness perpendicular to said upper burner surface, except in a region near said inlet port, the front portion of said burner cavity having a substantially constant thickness perpendicular to said front burner surface, said burner cavity having a generally L-shaped cross section in a plane perpendicular to said upper and front burner surfaces, said upper burner surface having top gas ports in gas communication with said burner cavity and said front burner surface having front gas ports in gas communication with said burner cavity, said base member having an inlet port that is located with respect to said gas ports so as to limit pressure differentials between said gas ports; and a mixing tube for supplying a mixture of air and gas from a gas source to said inlet port, said inlet port being located so as to supply said mixture of air and gas to the upper portion of said burner cavity from below, said base member having a downward bulge in the region of said inlet port so that the incoming mixture of gas and air expands and reduces in velocity as it enters said burner cavity.

2. A gas burner as defined in claim 1 wherein said front gas ports comprise a plurality of elongated, horizontal slits in a linear arrangement.

3. A gas burner as defined in claim 1 wherein said top member comprises stainless steel and said base member comprises cast iron.

4. A gas burner as defined in claim 3 wherein said stainless steel top member has a thickness of about 1/16 inch.

5. A gas burner as defined in claim 3 wherein said stainless steel top member comprises a single sheet of substantially constant thickness which defines said upper and front burner surfaces.

6. A gas burner as defined in claim 1 wherein said upper burner surface includes at least one opening for supplying secondary air to a region above said upper burner surface.

7. A gas log heater comprising:

a firebox defining a combustion chamber and including an air inlet and an exhaust gas outlet;

a gas burner located within said firebox, said gas burner comprising a thin metal top member having substantially flat, intersecting top and front burner surfaces;

a metal base member affixed to said top member and, together with said top member, defining a burner cavity, said burner cavity including an upper portion below said upper burner surface and a front portion behind said front burner surface, the upper portion of said burner cavity having a substantially constant thickness perpendicular to said upper burner surface, except in a region near said inlet pert, the front portion of said burner cavity having a substantially constant thickness perpendicular to said front burner surface, said burner cavity having a generally L-shaped cross section in a plane perpendicular to said upper and front burner surfaces, said upper burner surface having top gas ports in gas communication with said burner cavity and said front burner surface having front gas ports in gas communication with said burner cavity, said base member having an inlet portion that is located with respect to said gas ports so as to limit pressure differentials between said gas ports; and a mixing tube for supplying a mixture of air and gas from a gas source to said inlet port, said inlet port being located so as to supply said mixture of air and gas to the upper portion of said burner cavity from below, said base member having a downward bulge in the region of said inlet port so that the incoming mixture of gas and air expands and reduces in velocity as it enters said burner cavity; and a plurality of artificial logs located within said firebox and positioned relative to said gas burner such that said gas burner produces flames around said artificial logs, said flames and said artificial logs simulating the appearance of a wood fire.

8. A gas log heater as defined in claim 11 wherein front gas ports comprise a plurality of elongated horizontal slits in a linear arrangement.

9. A gas log heater as defined in claim 11 wherein said top member comprise a sheet of stainless steel having a thickness of about 1/16 inch.

10. A gas log heater as defined in claim 7 wherein said gas burner further includes a gas control valve mounted to said base member for controlling the supply of gas between said gas source and said mixing tube.

* * * * *